US005155940A

United States Patent [19]

Suzuki

[11] Patent Number: 5,155,940

[45] Date of Patent: Oct. 20, 1992

[54] APPARATUS FOR JUDGING WHETHER AN UNCUT LENS SHOULD BE MACHINED OR NOT AND LENS GRINDING MACHINE HAVING THE SAME

[75] Inventor: Yasuo Suzuki, Tokyo, Japan

[73] Assignee: Kabushiki Kaisha Topcon, Tokyo, Japan

[21] Appl. No.: 604,483

[22] Filed: Oct. 26, 1990

[30] Foreign Application Priority Data

Oct. 30, 1989 [JP] Japan ..... 1-284306
Oct. 30, 1989 [JP] Japan ..... 1-284307

[51] Int. Cl.[5] ..... B24B 49/00

[52] U.S. Cl. ..... 51/165.71; 51/165.72; 51/101 LG

[58] Field of Search ..... 51/165 R, 165.71, 165.72, 51/105 LG, 106 LG, 100 R, 101 R, 101 LG

[56] References Cited

U.S. PATENT DOCUMENTS 4,524,419 6/1985 Headlund et al. ..... 51/165.72
4,557,077 12/1985 Kolb ..... 51/165.72
4,656,590 4/1987 Ace ..... 51/165.72
4,723,376 2/1988 Blum et al. ..... 51/165.72
4,737,918 4/1988 Langlois et al. ..... 51/165.72

FOREIGN PATENT DOCUMENTS 61-274859 5/1986 Japan .

*Primary Examiner*—M. Rachuba
*Attorney, Agent, or Firm*—Finnegan, Henderson, Farabow, Garrett and Dunner

[57] ABSTRACT

An apparatus for judging whether or not an uncut lens should be machined is provided. The apparatus judges whether or not a lens having a desired lens frame configuration can be obtained from an uncut lens before the lens is subjected to a grinding treatment by a lens grinding machine. The apparatus also judges whether or not an already sucked and attached uncut lens should be machined by judging whether a "machining interference" caused by a sucking disk sucked and attached to the uncut lens will come in contact with a grinding wheel, and/or whether or not a lens of a desired lens frame configuration can be obtained from the uncut lens before the uncut lens with the sucking disk already sucked and attached thereto is subjected to a grinding treatment. A lens grinding machine incorporating such a judging apparatus is also provided.

21 Claims, 7 Drawing Sheets

FRAME CONFIGURATION MEASURING APPARATUS
FRAME CONFIGURATION MEMORY
SUCKING DISK CONFIGURATION MEMORY
ARITHMETIC/ JUDGMENT CIRCUIT
IMAGING CIRCUIT
CONTROL CIRCUIT
MACHINING DATA MEMORY
MACHINING CONTROL CIRCUIT
FPD
PD
UP
LENS (D)
MIN LENS (D)
CIRCULAR CYLINDRICAL AXIS - ANGLE
ECCENT -RIC
IN
SET
72.0
64.0
3.0
80
72
30°
30°

APPARATUS FOR JUDGING WHETHER AN UNCUT LENS SHOULD BE MACHINED OR NOT AND LENS GRINDING MACHINE HAVING THE SAME

BACKGROUND OF THE INVENTION

1. Field of the Invention

This invention relates to an apparatus for judging whether an uncut lens should be machined or not and a lens grinding machine or lens edge grinding machine having the same, in which a judgment is made as to whether a lens having a desired lens frame configuration from an uncut lens before the uncut lens is subjected to grinding treatment by the lens grinding machine.

2. Description of the Prior Art

Heretofore, a lens grinding machine is used for grinding an uncut lens (material lens) into a lens frame configuration can be obtained of a spectacle frame to which the lens is to be enframed. Before the uncut lens is ground by the lens grinding machine, the axis (or center axis) of a sucking disk or sucking device is brought into alignment with the optical center of the uncut lens and then the sucking disk is allowed to be sucked and attached to the uncut lens. The sucking disk has a shaft portion for mounting to a rotating shaft of the lens grinding machine and a rubber cup for sucking the lens. When this sucking disk is sucked and attached to the lens, the diameter of the sucking disk becomes generally equal to or slightly greater than the diameter of the lens mounting shaft.

When the peripheral edge of the material lens is ground into the lens frame configuration, a shaft portion of the sucking disk is coaxially held by the lens rotating shaft of the lens grinding machine, the peripheral edge portion of the uncut lens is ground by a grinder which is rotating at a high speed while the rotational axis of the lens is being rotated. At that time, it is a usual practice that the peripheral edge portion of the uncut lens is ground such that the optical center or optical axis of the lens has a desired displacement relative to the geometrical center of lens frame.

Also, today, the lens machining processes are divided or specialized. For example, the lens machining processes include a dot marking process to a material lens, a sucking process for sucking and attaching the sucking disk to the material lens accompanying an aligning or centering process of the material lens, and a grinding process made by a lens grinding machine after the material lens has been sucked by the sucking disk.

Today, where the lens machining processes are such specialized as mentioned, there is such a possibility as to invite a failure in that it is found that a desired lens frame configuration cannot be obtained only after the material lens has actually been machined. However, if we take into consideration such a serious fact as that a material lens once failed in machining is usually unable to be machined again, this can be a vital loss to a spectacle store.

In order to avoid such an undesirable incidence, it also becomes an important work to check as to whether a desired lens frame configuration (outer configuration) can be obtained or not, if an uncut lens is subjected to grinding treatment made by a lens grinding machine.

Heretofore, this checking operation was performed using a template which was obtained by machining a material plate copying the lens frame configuration before the sucking disk is sucked and attached to the uncut lens. Moreover, when in such checking, the template and the uncut lens were superimposed upon each other in such a manner as that the geometrical center of the template is moved from the optical center of the uncut lens by a desired amount, and it was checked whether the peripheral portion of the template is expanded from the peripheral edge of the uncut lens. And, when the peripheral portion of the template is expanded from the peripheral portion of the uncut lens, the uncut lens was judged as being not large enough to be machined into a template configuration and another selection of an uncut lens of a greater diameter was requested.

In recent years, there is a spectacle so called "Kanime lens (or pin face lens)" which is for the exclusive use of a shortsighted person and the width of a lens frame of which is extremely narrow in the vertical direction.

If an attempt is made to obtain such kanime lens or pin face lens from a circular-shaped material lens (uncut lens) by means of grinding using a lens grinding machine, it occurs a so-called "machining interference" occurs in which the sucking disk sucked and attached to the material lens is ground by the lens grinder. When this machining interference is grave, there is such a fear as that even a mounting member of the sucking disk is also contacted with the lens grinder to break the lens grinding machine itself.

Also, in case a material lens is to be machined into a general lens frame configuration other than the kanime lens, the machining interference also occurs when the displacement (usually called the "inwardly sided amount" or "upwardly sided amount") between the optical center of the uncut lens and the geometrical center of the lens frame is large.

The conventional method for checking the "machining interference" before it occurs is performed in such a manner as that a template obtained by copying a lens frame of a spectacle frame and an uncut lens are physically superposed one upon the other taking into consideration the displacing amount thereof, then the sucking disk is sucked and attached onto the uncut lens such that the center of the sucking disk is brought into alignment with the geometrical center of the template, and then it is checked whether the sucking disk expands from the template.

However, the conventional method for checking an outer diameter machinability using a template and the conventional method for checking the machining interference are very complicated to put into practice. Moreover, if the sucking disk is sucked and attached to the lens before the machining interference is checked, a dot mark on the uncut lens serving as a target mark for centering the displacing position between the uncut lens and the template is hidden by the sucking disk and, therefore, the centering operation of the displacing position thereof becomes impossible to carry out. As a result, it becomes impossible to carry out the checking as for machining interference.

On the other hand, a lens grinding machine requiring no template came into practice in recent years. As such lens grinding machine, there is known, for example, a "non-former lens grinding machine" or a "patternless lens grinding machine" like a lens grinding machine as disclosed in detail in a Japanese Patent Application No. 60-115079 filed earlier by the present applicant.

In this new lens grinding machine, the configuration of a lens frame of a spectacle frame is measured by a frame configuration measuring apparatus as one element of the constituent system of the lens grinding machine in order to obtain the distance (radius vector $\rho_1$) from the geometrical center of the lens frame to the V-edge groove of the lens frame every predetermined angle $\theta_1$. At that time, the radius vector information ($\rho_1$, $\theta_1$) (i=1, 2, 3, . . . N here) is obtained as an electric signal by mechanical/electrical measurement. Thereafter, the lens machining radius vector ($_k\rho_1$, $_k\theta_1$) (i=1, 2, 3, . . . N here) is found by adding the displacing amount between the uncut lens and the lens frame to this electric signal, and the material lens is ground with reference to the lens machining radius vector. The sucking disk is normally sucked and attached to the optical center of the material lens.

The lens grinding machine disclosed in the above-mentioned Japanese Patent Application No. Sho 60-115079 has a lens configuration measuring apparatus for measuring the configuration of a material lens. And this lens grinding machine is designed such that fillers are brought into abut engagement with front and rear refracting surfaces of the uncut lens along the radius vector orbit with reference to the lens machining radius vector ($_k\rho_1$, $_k\theta_1$), and when these fillers are disengaged from the uncut lens, it is automatically judged that a desired lens frame configuration from this material lens and a warning is issued.

In such non-former lens grinding machines, physical existence as a template does not exist, but only configuration data of the lens frame exists as an electric signal. Accordingly, it is impossible to check whether the machining interference is occurred or not by visually confirming the mutual positional relation between the lens frame configuration data and the sucking disks sucked and attached to the uncut lens.

Also in this non-former lens grinding machine, although it can overcome the complication of the checking work as to whether the outer configuration of the material lens can be machined, such judgment can be made only after the material lens has been set to the lens rotational shaft. Accordingly, in case it was judged that the material lens cannot be machined, this material lens is required to be replaced with a new material lens having a comparatively large diameter after the checking work has been finished to the material lens which was still in the half-way of the machining process. Moreover, at that time, it is required that the machining worker perform the centering work from the beginning all over again or the worker perform the centering work again to a new material lens having a larger diameter. This naturally turns out the merit of specialization to demerit.

SUMMARY OF THE INVENTION

A first object of the present invention is to provide an apparatus for judging whether an uncut lens should be machined or not, in which even a worker engaging in one machining process can check as to whether the outer configuration of a material lens can be machined or not before the lens is subjected to the grinding treatment.

A first construction of the present invention for achieving the first object is in an apparatus for judging whether an uncut lens should be machined or not, comprising image display means for displaying an image of a lens frame showing the configuration of a lens frame of a spectacle frame with a material lens enframed therein or of a template obtained by copying the same, position input means for inputting an optical center position of the material lens relative to a geometrical center of said lens frame, and lens diameter/radius input means for inputting the diameter/radius of the material lens, said image display means displaying said lens image having the center thereof in said optical center position and also having said diameter/radius together with said lens frame image.

With the first construction of the present invention, the image display means displays the lens frame configuration on its display screen, and also displays the lens image having the lens diameter of the material lens input by the lens diameter/radius input means such that the center thereof is located in the optical center position of the lens input by the position input means. The operator visually checks whether at least a part of the lens frame configuration expands outside the lens image. If the lens frame configuration is expanded outside, it judges that even if the material lens should be ground by the lens grinding machine, the desired lens frame configuration is unobtainable before the material lens is subjected to the machining treatment.

A second object of the present invention is to provide a lens grinding machine having the above-mentioned machinability judging apparatus.

The second construction of the present invention is in an apparatus for judging whether an uncut lens should be cut or not, in which said position input means includes FPD input means for inputting a frame PD value of said spectacle frame, PD input means for inputting a distance value between pupils of the eyes of the spectacle user, arithmetic means for calculating a difference between said frame PD value and said distance value between the pupils and finding an inwardly sided amount of said material lens, and UP input means for inputting an upwardly sided amount of said material lens.

Furthermore, with the second construction of the present invention, the optical center position of the lens is decided by the inwardly sided amount automatically calculated by the position input means.

A third construction of the present invention is in an apparatus for judging whether an already sucked and attached uncut lens should be cut or not, which further includes judgment means for judging whether at least a part of said lens frame image expands outside said lens image or not, and warning means for issuing a warning when said judgment means has judged that at least a part of said lens frame image expands outside said lens image.

With the third construction of the present invention, it is automatically judged whether at least a part of the lens frame configuration expands outside the lens image or not, so that a judgment as to whether the outer configuration of the material lens can be machined or not can be made, and when at least a part of the lens frame configuration expands outside the lens image, the warning means automatically issues a warning to the operator that even if the material lens should be ground by the lens grinding machine, said lens frame configuration cannot be obtained.

A fourth construction of the present invention for achieving the second object is in a lens grinding machine for inputting configuration data of a lens frame of a spectacle frame with a material lens enframed therein or of a template obtained by copying thereof, and grinding the material lens based on the configuration data, wherein said lens grinding machine having the machinability judging apparatus, the apparatus having any of the above-mentioned first to third constructions.

With the fourth construction of the present invention, the construction and function of the apparatus for judging whether an uncut lens should be machined or not can be added to the lens grinding machine.

A third object of the present invention is to provide an apparatus for judging whether an uncut lens should be machined or not, which is capable of checking with machining interference even for an already sucked and attached material lens.

A fifth construction of the present invention for achieving the third object is in an apparatus for judging whether an already sucked and attached uncut lens should be machined or not including image display means for displaying the configuration of a lens frame of a spectacle lens frame with a material lens enframed therein, input means for inputting an optical center position of said material lens relative to a geometrical center of said lens frame, and memory means for initially storing an outer configuration of a sucking disk which is sucked and attached to the material lens, said image display means displaying the outer configuration of said sucking disk such that the center of the outer configuration of said sucking disk is located in said optical center position.

With the fifth construction of the present invention, the image display means displays an image of the lens frame configuration on the display screen, and also displays the outer configuration of the sucking disk on the display screen such that the center of the outer configuration of said sucking disk input is located in the optical center position of the material lens input by said input means. The operator can check whether there is a machining interference or not based on the judgment as to whether the image of the outer configuration of the sucking disk is included in a part of the lens frame configuration image before the material lens is subjected to the machining treatment.

A fourth object of the present invention is to provide an apparatus for judging whether a uncut lens should be machined or not, in which even the outer configuration of an already sucked and attached material lens can be checked on the side of a worker engaging in machining processes before the lens is subjected to the machining treatment.

A sixth construction for achieving the fourth object of the present invention is in an apparatus for judging whether an already sucked and attached uncut lens should be machined or not, in which said image display means is designed such that the material lens with the sucking disk sucked and attached thereto can be placed on a display surface thereof in such a manner as that the sucking disk is coincident with the outer configuration of the sucking disk.

Furthermore, with the sixth construction, the sucked and attached material lens is placed on the display screen of the displayer in such a manner as that the sucking disk is coincident with the displayed image of the outer configuration of the sucking disk in order to check whether even a part of the external periphery of the material lens is expanded from the lens frame configuration display image or not and to make a judgment, if expanded, prior to machining of the material lens that the external configuration cannot be machined.

A seventh construction of the present invention for achieving the third or fourth object is in an apparatus for judging whether an already sucked and attached uncut lens should be machined or not, in which said input means includes an FPD input means for inputting a frame PD value of said spectacle frame, a PD input means for inputting an inter-pupil distance value of the spectacle user, arithmetic means for calculating a difference between said frame PD value and said inter-pupil distance value and finding an inwardly sided amount of said material lens, and an UP input means for inputting an upwardly sided amount of said material lens.

With the seventh construction of the present invention, the optical center position of the lens is decided by the inwardly sided amount automatically calculated from the frame PD value and the inter-pupil distance value input by said input means and the upwardly sided amount input by said UP input means.

An eighth construction of the present invention is, in order to achieve the third object, in an apparatus for judging whether an already sucked and attached uncut lens should be machined or not, which further includes judgment means for judging whether at least a part of the external configuration of said sucking disk is "located" outside the configuration of said lens frame or said template or not, and warning means for issuing a warning to that effect when said judgment means has judged as "located".

With the eighth construction of the present invention, the judgment means automatically judges whether at least a part of the image displaying the external configuration of the sucking disk is located outside the image displaying the configuration of the lens frame or not, and the warning means automatically issues a warning to the operator telling that there is a machining interference when judged as "located".

Furthermore, a ninth construction of the present invention is in an apparatus for judging whether an already sucked and attached uncut lens should be machined or not, in which said memory means is adapted to store the radius of a sucking rubber of said sucking disk at the time said material lens is sucked and attached as the external configuration of said sucking disk.

With the ninth construction of the present invention, the external configuration of the sucking disk is stored in the memory means as a radius value at the time the sucking disk is sucked and attached to the lens and the image displaying the external configuration of the sucking disk is image displayed as a circle having said radius.

A fifth object of the present invention is to provide a lens grinding machine which is provided with the machinability judging apparatus in order to achieve the third and fourth objects.

And in order to achieve the fifth object, a tenth construction of the present invention is in a lens grinding machine for inputting a configuration data of the lens frame of the spectacle frame into which the material lens is to be enframed or of the template obtained by copying thereof and grinding the material lens based on said configuration data, said lens grinding machine being provided with the apparatus for judging whether an already sucked and attached uncut lens should be machined or not.

With the tenth construction of the present invention, the construction and function of the apparatus for judging whether an already sucked and attached uncut lens should be machined or not can be added to said lens grinding machine.

These and other objects, features and advantages of the present invention will be well appreciated upon reading of the following description of the invention when taken in conjunction with the attached drawings with understanding that some modifications, variations and changes of the same could be made by the skilled person in the art to which the invention pertains without departing from the spirit of the invention or the scope of claims appended hereto.

BRIEF DESCRIPTION OF THE ATTACHED DRAWINGS

Figure 7A:
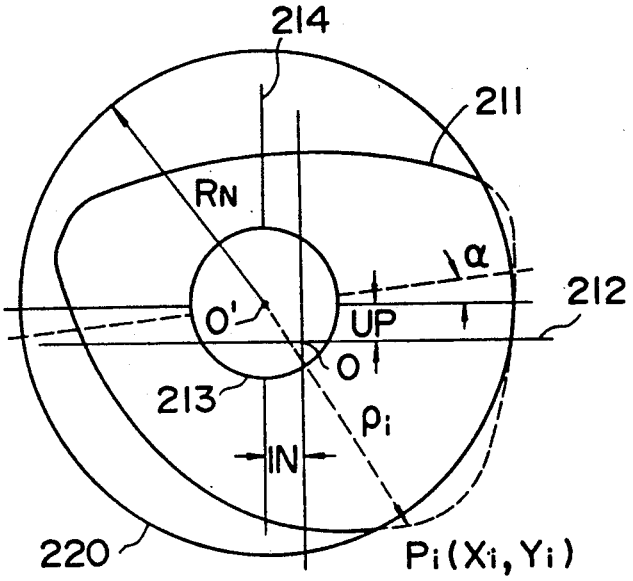
FIG. 7A is a diagrammatical view showing the correlation among the lens image, the lens frame image and the image of the external configuration of the sucking disk when the lens frame configuration cannot be taken from the material lens.
Figure 7B:
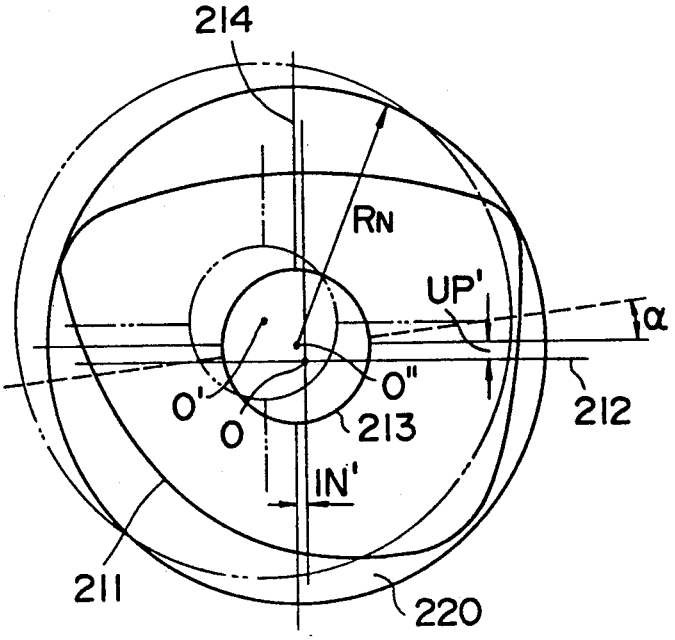
Figure 8:
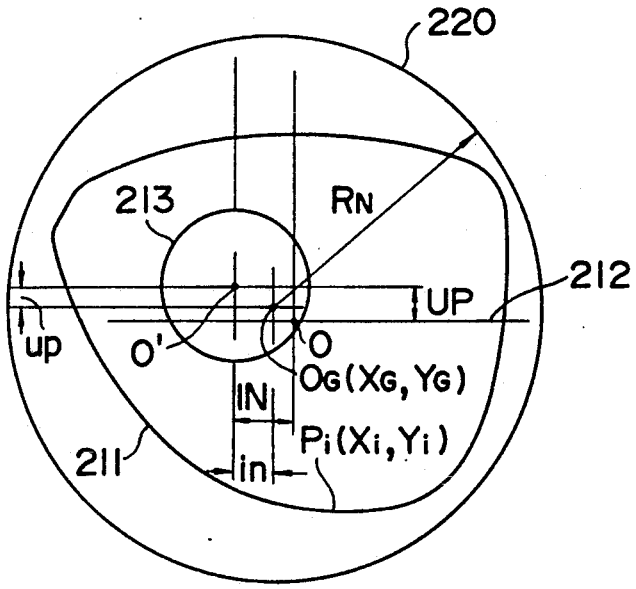

FIG. 7B is a diagrammatical view showing one example in which the lens image and the image of the external configuration of the sucking disk are moved from the state of FIG. 7A and brought to a state where the lens frame configuration can be taken; and FIG. 8 is a diagrammatical view showing the correlation among the lens image, the lens frame image and the image of the external configuration of the sucking disk when an eccentric lens is utilized.

DESCRIPTION OF THE PREFERRED EMBODIMENT

One embodiment of the present invention will be described hereunder with reference to the accompanying drawings.

[CONSTRUCTION]

Figure 1:
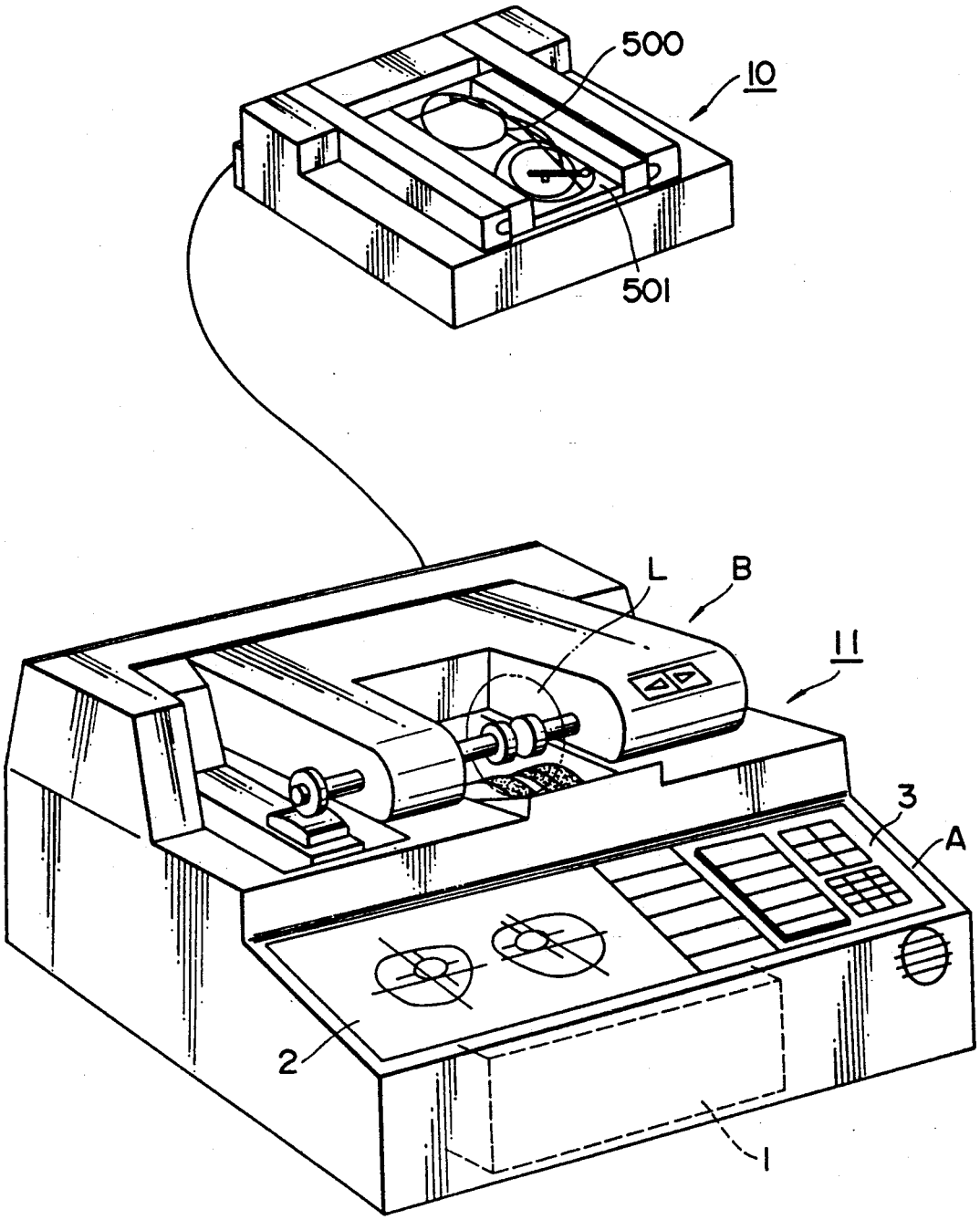
FIG. 1 is a perspective view of the outer appearance of a lens grinding machine having an apparatus for judging whether an uncut lens should be machined or not according to the present invention.

FIG. 1 is a perspective view showing the outer appearance of a lens grinding machine having an apparatus for judging whether an uncut lens should be machined or not according to the present invention.

The numeral 10 denotes a frame configuration measuring apparatus which is adapted to measure, mechanically/electrically, the configuration of a lens frame 501 of a spectacle frame 500 or the configuration of a template (not shown) obtained by copying the lens frame 501. This frame configuration measuring apparatus 10 is electrically connected to a lens grinding machine body 11.

The lens grinding machine body 11 is a nonformer lens grinding machine for grinding an uncut lens (material lens)L based on configuration data of the lens frame 501 coming from the frame configuration measuring apparatus 10.

Since the details of the constructions of the frame configuration measuring apparatus 10 and the lens grinding machine body 11 is the same to that disclosed in the above-mentioned Japanese Patent Application No. Sho 60-115079, description thereof will be omitted.

An operating portion A disposed in front of a machining portion B of the lens grinding machine body 11 is provided with an electric circuit 1, a displayer 2, and an input keyboard 3 all constituting the machinability judging apparatus.

Figure 2:
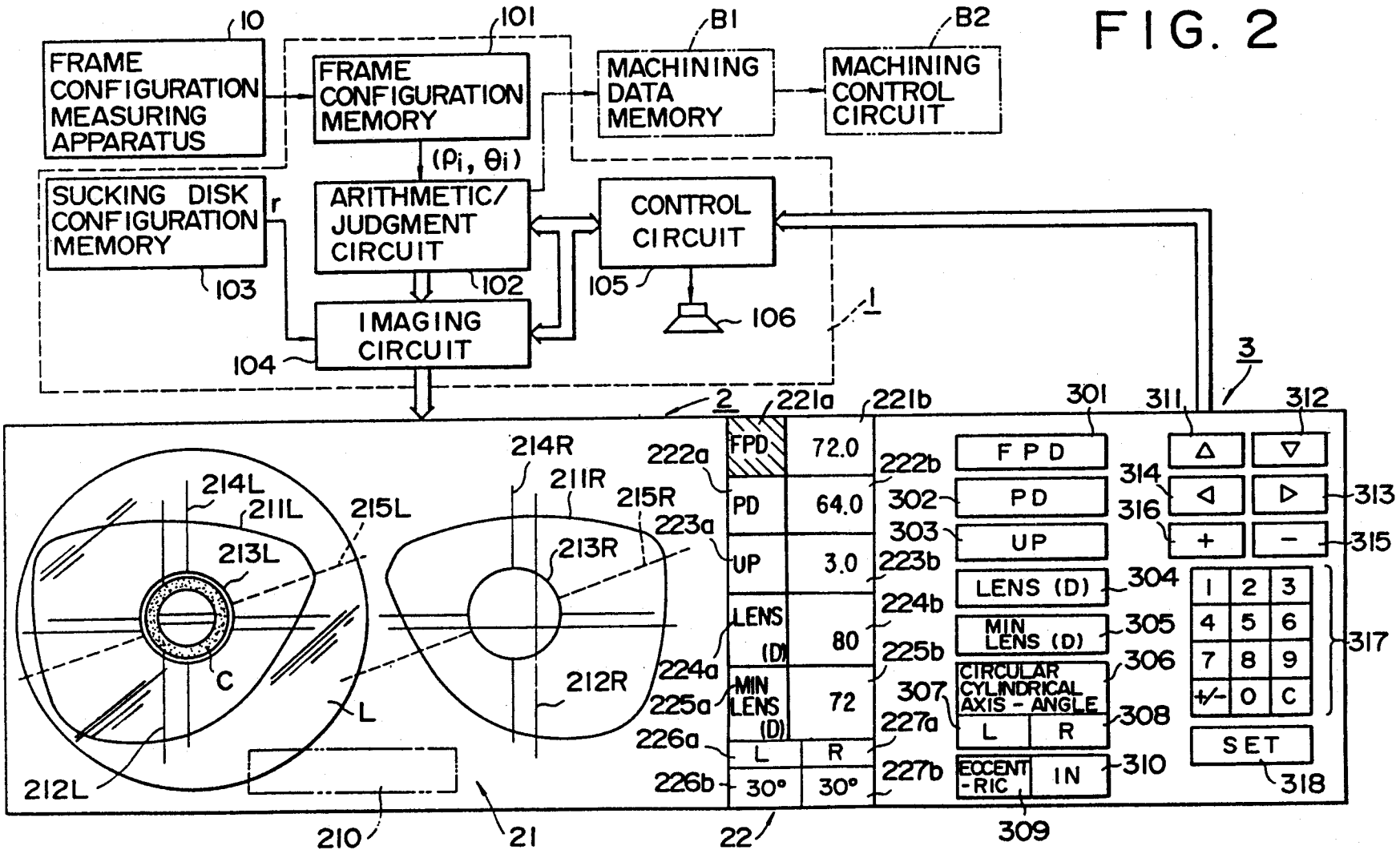
FIG. 2 is a block diagram showing the construction of the apparatus for judging whether an uncut lens should be machined or not.

As shown in FIG. 2, the electric circuit 1 includes a lens frame configuration memory 101 for storing vector radius information ($\rho_i$, $\theta_i$)(i=1, 2, 3, . . . N here) of the lens frame 501 measured by the frame configuration measuring apparatus 10, and this lens frame configuration memory 101 is connected to an arithmetic/judgment circuit 102. The arithmetic/judgment circuit 102 is connected with an image processing circuit (imaging processing unit) or an imaging circuit 104 and a control circuit 105, and the control circuit 105 is connected with a buzzer 106 as one of warning means. A sucking disk configuration memory 103 is connected to the imaging circuit 104. Also, the arithmetic/judgment circuit 102 is connected to a machining control circuit B2 belonging to a machining portion B through a machining data memory B1. Since the constructions and functions of the machining data memory B1 and the machining control circuit B2 are the same to that disclosed in the above-mentioned Japanese Patent Application No. Sho 60-115079, description thereof will be omitted.

The imaging circuit 104 is connected to the displayer 2 comprising, for example, a liquid crystal displayer. This displayer 2 includes an image display portion 21 and a data display portion 22. The control circuit 105 is connected with the input keyboard 3.

Also, the display content of the displayer 2 and the construction of various input keys of the input keyboard 3 will be described in the following description of the operation.

[OPERATION]

① Data Input

When the configuration of the lens frame 501 of the spectacle frame 500 has been measured by the frame configuration measuring apparatus 10 and the vector radius information ($\rho_i$, $\theta_i$) has been stored in the lens frame configuration memory 101, the operator operates an FPD-key 301 of the input keyboard 3, controls the imaging circuit 104 through the control circuit 105 to switch an "FPD" index **221*a* of the data display portion 22 to a white letter display (indicated by double struck slant lines in FIG. 2), and operates ten-key 317 to input a frame PD value FPD to have the "FPD" display portion 221*b*** display numerical values.

Next, the operator operates a PD-key 302 of the input keyboard 3, switches a "PD" index **222*a* of the data display portion 22 to a white letter display, and operates the ten-key 317 to input the spectacle user's inter-pupil distance value PD to have the "PD" display portion 222b display numerical values. Furthermore, where an upwardly sided amount UP is required to be input, the operator operates UP-key 303 to switch an "UP" index 223a of the data display portion 22 of the data display portion 22 to a white letter display, and operates the ten-key 317 to input the upwardly sided amount UP to have the "UP" display portion 223b display numerical values. Also, a circular cylindrical axis angle-key 306, an R-key 308 and the ten-key 317 are operated to input a right eye circular cylindrical axis angle $\alpha_r$ to have an "R" display portion 227b display numerical values. Likewise, the circular cylindrical axis angle-key 306, an L-key 307, and the ten-key 317 are operated to input a left eye circular cylindrical axis angle $\alpha_l$ to have the "L" display portion 226b** display numerical values.

The frame PD value FPD, the inter-pupil distance value PD and the upwardly sided value UP are input into the arithmetic/judgment circuit 102 through the control circuit 105 by operating a set-key 318 each time. Also, the circular cylindrical axis angles $\alpha_r$, $\alpha_l$ are input into the imaging circuit 104 through the control circuit 105.

Figure 3:
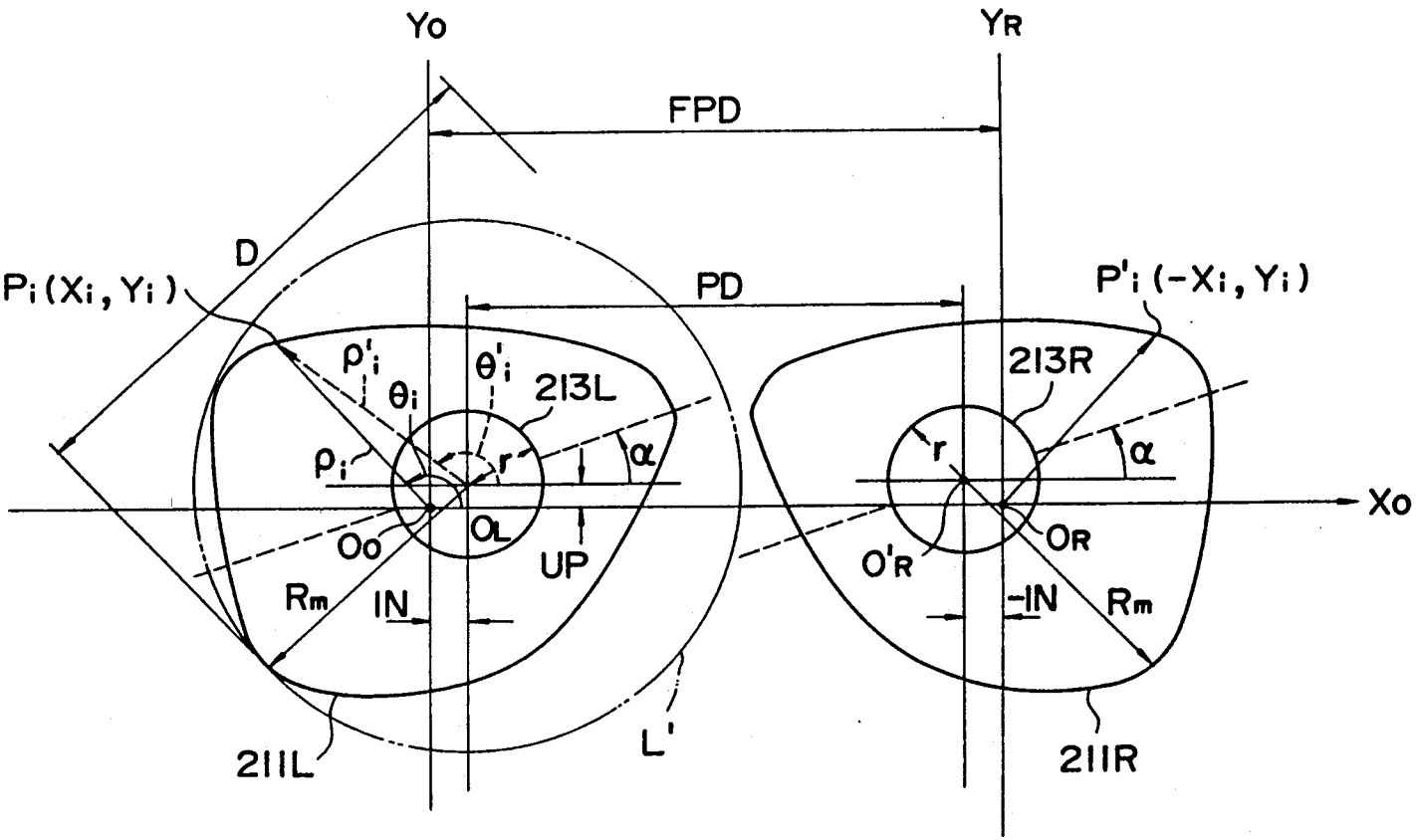
FIG. 3 is a diagrammatical view for explaining the image display relation between a lens frame image and an image of the external configuration of a sucking disk and a method for finding the minimum lens diameter.

(2) Image Display of Lens Frame Image and External Configuration of Sucking Disk As is diagrammatically shown in FIG. 3, the arithmetic/judgment circuit 102 finds the coordinates ($X_i$, $Y_i$) in an $X_\theta$-$Y_\theta$ coordinate system of each measuring point $P_i$(i=1, 2, 3, . . . N here) of the lens frame utilizing the vector radius information ($\rho_i$, $\theta_i$) of the left eye lens frame stored in the lens frame configuration memory 101 from the following equations;

$$X_i = \rho_i \cdot \cos\theta_i \quad (1)$$

$$Y_i = \rho_i \cdot \sin\theta_i \quad (2)$$

and these coordinates $P_i(X_i, Y_i)$ are input into the imaging circuit 104.

The imaging circuit 104 image displays the left eye lens frame image 211L in accordance with the $X_\theta$-$Y_\theta$ coordinate system predetermined in the image display portion 21 of the displayer 2 utilizing the coordinates $P_i(X_i, Y_i)$.

Likewise, the arithmetic/judgment circuit 102 performs the similar calculation as the equation (1) for the vector radius information of the right eye lens frame stored in the lens frame configuration memory 101, and image displays the right eye lens frame image 211R in accordance with the $X_\theta$-$Y_R$ coordinate system in which the frame PD value FPD portion YR axis is moved from the $Y_\theta$ coordinate axis.

By this, the left eye lens frame image 211L and the right eye lens frame image 211R are image displayed on the image display portion 21 with the geometrical centers $O_\theta$, $O_R$ thereof spaced apart in the image frame PD value FPD portion X0 axial direction. Also, the imaging circuit 104 image displays the lens frame center targets 212L and 212R comprising reticules which are coincident with the geometrical center $O_\theta$, $O_R$ positions at crossing points showing the geometrical centers $O_\theta$, $O_R$ positions of the lens frames.

If only the vector radius information ($\rho_i$, $\theta_i$) of the left eye lens frame is stored in the lens frame configuration memory 101 (as the left and right lens frame configurations are usually the same, the configuration of only one lens frame is measured in many cases), the left eye lens frame configuration may be inverted with reference to the $Y_\theta$ axis as shown in FIG. 3, that is, the X coordinate of the coordinates $P_i(X_i, Y_i)$ may be multiplied by (−1) to obtain the coordinates $P_i(-X_i, Y_i)$, and then these coordinates $P_i(-X_i, Y_i)$ may be allowed to follow the $X_\theta$-$Y_R$ coordinate system to image display the right eye lens frame image 211R.

The arithmetic/judgment circuit 102 calculates an inwardly sided amount IN from the frame PD value FPD and the inter-pupil distance value PD based on the following equation;

$$IN = \frac{FPD - PD}{2} \quad (3)$$

and by utilizing the inwardly sided amount IN and the upwardly sided amount UP input through the input keyboard 3, the left eye sucking disk center $O_L$(IN, UP) is determined in a position displaced by the inwardly sided amount IN portion in the $X_\theta$ axis direction and upwardly sided amount UP portion in the $Y_\theta$ axis direction from the origin $O_\theta$ (geometrical center of the left eye lens frame image 211L), and the same is input into the imaging circuit 104. Then, the imaging circuit 104 reads the radius r of the sucking disk C stored in the sucking disk configuration memory 103 and image displays the left eye sucking disk external configuration image 213L comprising a circle having a radius r drawn about the left eye sucking disk center $O_L$(IN,UP) on the image display portion 21.

Likewise, the arithmetic/judgment circuit 102 determines the right eye sucking disk center $O_R$(−IN, UP) in a position displaced by the inwardly sided amount −IN portion obtained based on the equation (3) in the $X_\theta$ axis direction and the upwardly sided amount UP portion in the $Y_\theta$ axis direction, and inputs the same into the imaging circuit 104. The imaging circuit 104 reads the radius r of the sucking disk C stored in the sucking disk configuration memory 103, and image displays the right eye sucking disk external configuration image 213R comprising a circle having a radius r and drawn about the right eye sucking disk center $O_R$(−IN, UP) on the image display portion 21.

Also, the imaging circuit 104 image displays the sucking disk center targets 214L, 214R in which the respective crossing points showing the sucking disk centers $O_L$, $O_R$ are coincident with the sucking disk centers $O_L$, $O_R$ on the image display portion 21.

Furthermore, the imaging circuit 104 image displays the circular cylindrical axis angular lines 215L, 215R rotated by the circular cylindrical axis angles $\alpha_r$, $\alpha_l$ portion from the horizontal lines of the sucking disk center targets 214L, 214R based on the circular cylindrical axis angles $\alpha_r$, $\alpha_l$ input through the input keyboard 3 on the image display portion 21.

(3) Machining Interference Check

The operator judges from the display image whether even a part of the left eye sucking disk external configuration image 213L is located in an outside area of the left eye lens frame image 211L image displayed on the image display portion 21 or not. Likewise, the operator judges by eye from the display image whether even a part of the right eye sucking disk external configuration image 213R is located in an outside area of the right eye lens frame image 211R image displayed on the image display portion 21 or not. If a part of the right eye sucking disk external configuration image 213R is included in the outside area 217 of the right eye lens frame image 211R as exemplified in FIG. 4, it judges as "there is a machining interference".

It may be designed such that instead of the operator's judgment of the machining interference by eye, the arithmetic/judgment circuit 102 judges whether a part of the sucking disk external configuration image 213 is included in the outside area of the lens frame image 211 or not.

Figure 4:
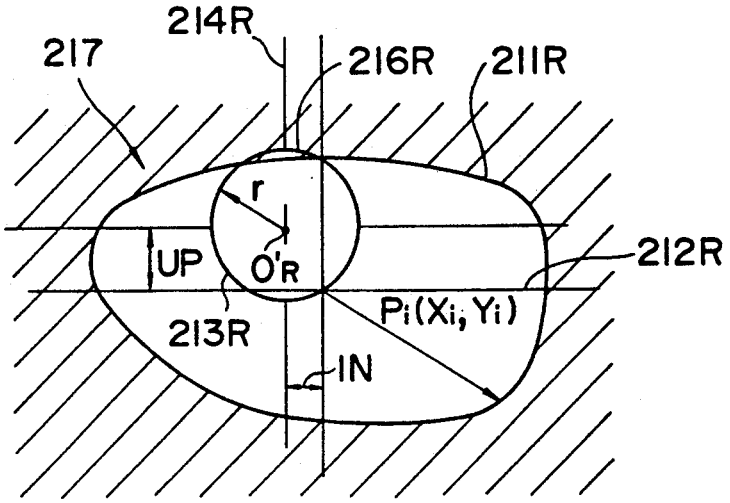
FIG. 4 is a diagrammatical view showing one example of the image display when there is a machining interference.

For example, as is shown in FIG. 4, an equation of a circle for forming an image of the sucking disk external image 213 (as the same idea can be applied to the images of the right and left eyes, the reference characters R. L will be omitted) can be expressed as follows;

$$(X-\mathrm{IN})^2+(Y-\mathrm{UP})^2=r^2 \quad (4)$$

All dots of the lens frame coordinates $P_i(X_i, Y_i)$ forming the lens frame image 211 are substituting into the equation (4). And when there is even a dot of coordinate satisfying the following equation;

$$(X_i-\mathrm{IN})^2+(Y_i-\mathrm{UP})^2 \leqq r^2 \quad (5)$$

it indicates that a part of the lens frame image 211 is included in or contacts with the sucking disk external configuration image 213 and the arithmetic/judgment circuit 102 judges that there is a generation of machining interference.

When the arithmetic/judgment circuit 102 judges "there is a machining interference", it instructs the control circuit 105 to that effect, and the control circuit 105 actuates the buzzer 106 to issue a warning to the operator.

Where the machining interference is negligibly small in amount and there is little problem in view of spectacle treatment even if the decentering amount (inwardly sided amount, upwardly sided amount) from a refractive force of the lens L is slightly changed, it may be designed such that a R-key 307, an L-key 308 and arrow-keys 311 through 313 are operated to image move the sucking disk external configuration image 213 in the vertical and horizontal directions to bring the sucking disk external configuration image 213 into a position where the machining interference is removed. In association with this image movement, the arithmetic/judgment circuit 102 calculates the change of the inter-pupil distance value PD and the upwardly sided amount UP and displays the values on the "PD" display portion **222*b* and "UP" display portion 223*b*, respectively. Relatively same effects can be obtained, if the lens frame image 211 is moved instead of moving the sucking disk external configuration image 213**.

The arithmetic/judgment circuit 102 automatically judges whether there is machining interferences of sucking disk external configuration images 218, 219 for the kanime lens or not as follows. That is, if the Y coordinate $Y_j$ of the lens frame coordinates $P_j(X_j, Y_j)$ where the above-mentioned equation (5) is established is $Y_j > Y_A$ with respect to the Y coordinate $Y_A$ of the horizontal line 218 of the sucking disk external configuration image for the kanime lens, the arithmetic/judgment circuit 102 judges "there is no machining interefference", and if $Y_j \leqq Y_A$, it judges "there is a machining interference".

④ Checking as to Whether External Configuration Should be Machined or Not

The control circuit 105 instructs the imaging circuit 104 to display a message reading "place an already sucked and attached lens here" on a message display portion 210.

According to the above message, the operator places the uncut lens (material lens) L for the left eye with the sucking disk C sucked and attached to the optical center thereof on the display screen of the image display portion 21 of the displayer 2 in such a manner as that the sucking disk C is coincident to the sucking disk external configuration image 213L as shown in FIG. 2 using a known centering device.

By this, the lens L is coincident to the sucking disk center $O_L$ (see FIG. 3) at its optical center. This means that the optical center of the lens L is coincident to the center of the pupil of the spectacle user when he/she wears the spectacle.

Figure 5:
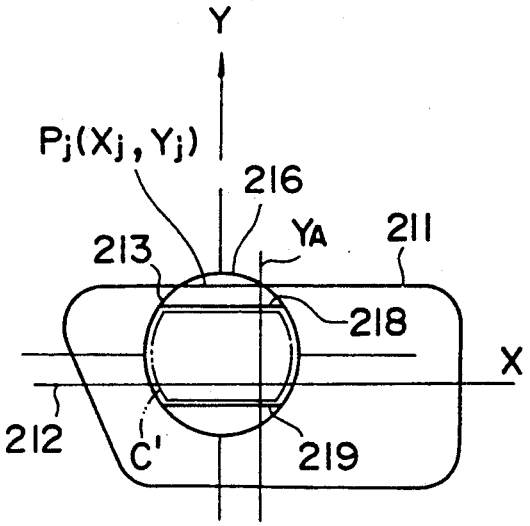
FIG. 5 is a diagrammatical view showing the image display relation between an image of the external configuration of a sucking disk for a kanime lens and the lens frame image.

In the case of an uncut lens with a sucking disk C' for the kanime lens sucked and attached thereto, the lens is placed on the display screen in such a manner as that the sucking disk C' is coincident to the sucking disk external configuration images 218, 219 for the kanime lens as shown in FIG. 5.

The operator checks through the eye as to whether the external periphery of the uncut lens L is included in the lens frame image 211L. As is shown in FIG. 2, when the entire external periphery of the lens L is located in the outside area of the lens frame image 211L, it is judged that the lens frame configuration "can be taken" in this eccentric position of the lens L by grind machining.

The similar checking as to whether the external configuration should be machined or not is also performed to the uncut lens (material lens) for the right eye.

Figure 6A:
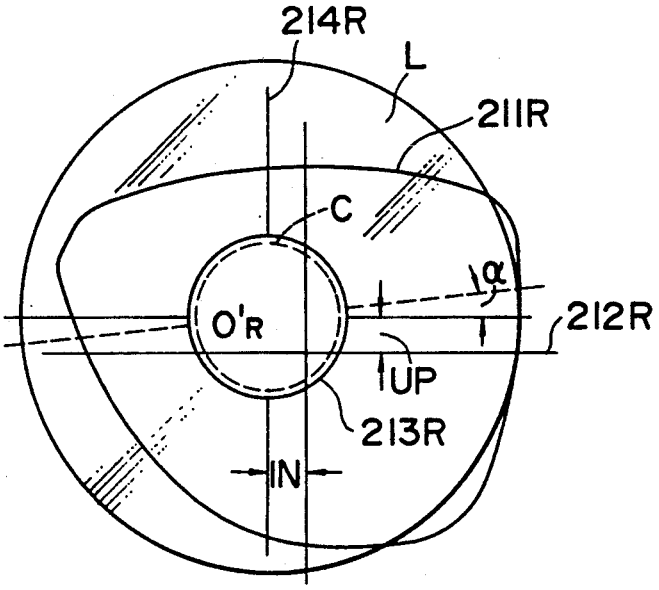
FIG. 6A is a grammatical view showing the correlation among the lens frame image, the image of the external configuration of the sucking disk and the material lens placed when the lens frame configuration cannot be taken from the material lens.

For example, as is exemplified in FIG. 6A, in case a part of the external periphery of the uncut lens (material lens) L for the right eye is included in the inside area of the right eye lens frame configuration image 211R, it is judged that the lens frame configuration "cannot be taken" in this eccentric position of the lens L by grind machining.

Figure 6B:
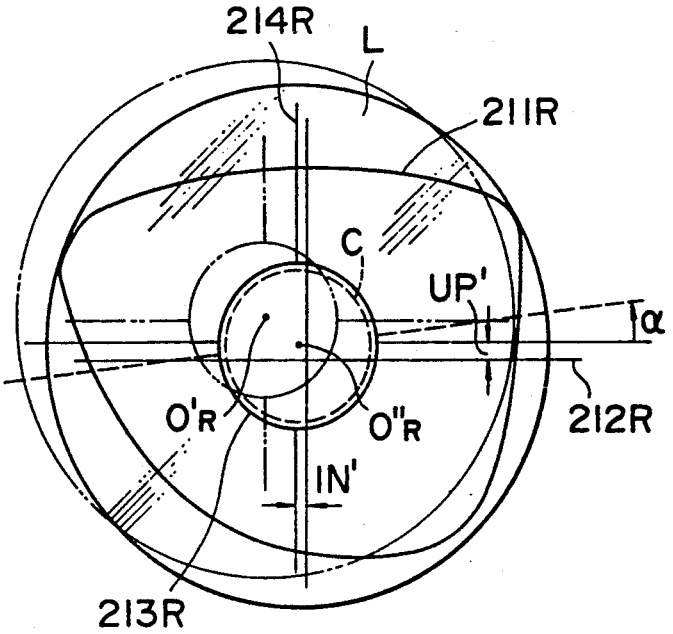
FIG. 6B is a diagrammatical view showing one example in which the material lens is moved from the state of FIG. 6A and brought to a state where the lens frame configuration can be taken.

In case it was judged as "cannot be taken" by the operator's eye, the material lens is usually exchanged for another lens having a larger diameter, but in case the refractive force of the lens is small, or depending on angles of the circular cylindrical axis, the lens L may be moved on the display screen in such a manner as that the lens frame image 211 will be included within the lens L as shown in FIG. 6B. After the lens L has been moved as shown in FIG. 6B, the operator operates a R-key 308 (since the lens for the right eye was moved in the example of FIG. 6B), and the arrow-keys 311 through 313 to image move the sucking disk image 213R in such a manner as to be coincident to the sucking disk C sucked and attached to the lens L. The arithmetic/judgment circuit 102 calculates a new inter-pupil distance value PD and a new upwardly sided amount UP in accordance with the movement of the sucking disk image 213R and displays the respective values on the "PD display portion **222*b* and "UP" display portion 223*b***.

Instead of checking as to whether the external configuration should be machined or not by the eye of the operator as mentioned above, it may be designed such that the arithmetic/judgment circuit 102 automatically checks whether the external configuration should be machined or not. In that case, the operator operates a lens diameter-key and the ten-key 317 to input the diameter of the uncut lens L into the arithmetic/judgment circuit 102 through the control circuit 105.

The arithmetic/judgment circuit 102 calculates a radius RN of the lens L from such input lens diameter $\div 2 = R_N$ and inputs this radius $R_N$ into the imaging circuit 104.

The imaging circuit 104, as shown in FIG. 7A, image displays the lens image 220 on the image display portion 21 by a circle having the radius RN and drawn about a lens optical center O' (coincident to the sucking disk center) which is moved from the geometrical center O' of the lens frame image 211 by a decentering amount, that is, inwardly sided amount IN and upwardly sided amount UP.

The circle of the lens image 220 can be expressed, as in the equation (4), by the following equation;

$$(X-\mathrm{IN})^2+(Y-\mathrm{UP})^2=R_N^2 \quad (6)$$

from the lens radius $R_N$, and the decentering amounts IN, UP. Accordingly, the whole dots of the lens frame configuration coordinates $P_i(X_i, Y_i)$ forming the lens frame image 211 are substituted into this equation (6). And if there is even one dot where the coordinate satisfies the following equation;

$$(X_i-\mathrm{IN})^2+(Y_i-\mathrm{UP})^2<R_N^2 \quad (7)$$

the arithmetic/judgment circuit 102 determines that a part of the lens frame image 211 is expanded from the lens image of the radius RN as shown in FIG. 7A, judges that the required lens frame configuration "cannot be taken" from this lens L, and instructs the control circuit to actuate the warning buzzer 106.

Even if it was judged as "cannot be taken" as a result of the automatic external configuration checking as to whether the material lens should be machined or not by this arithmetic/judgment circuit 102, in case the refractive force of the lens is small, or depending on angles of the circular cylindrical axis, the lens image 220 may be image moved in such a manner as that the lens frame image 211 will be included within the lens image 220 as shown in FIG. 7B. In that case, the operator operates a R-key 308 or an L-key 307 and the arrow-keys 311 through 313 to image move the sucking disk image 213 and the lens image 220 together as such that the lens frame image 211 will be included in the lens image 220. The arithmetic/judgment circuit 102 calculates a new inter-pupil distance value PD and a new upwardly sided amount UP and displays the respective values on the "PD display portion **222*b* and "UP" display portion 223*b***.

As is shown in FIG. 8, when an eccentric lens, which is decentered upwardly by up and inwardly by in from the geometrical center $O_G$, is used, the eccentric-key 309, the IN-key 310 and the ten-key 317 is operated to input the decentering amounts up and in of the eccentric lens into the arithmetic/judgment circuit 102 through the control circuit 105. The arithmetic/judgment circuit 102 finds the coordinates $(X_G, Y_G)$ of the geometric center $O_G$ of the eccentric lens from the decentering amounts IN and UP between the lens optical center O' (coincident to the sucking disk center) and the geometrical center O of the lens frame image 211 which are already input, and the decentering amounts up, in of the eccentric lens which are input this time as follows;

$$X_G=\mathrm{UP}-\mathrm{up} \quad (8)$$

$$Y_G=\mathrm{IN}-\mathrm{in} \quad (9)$$

And the imaging circuit 104 image displays the lens image 220 having a radius equal to the radius $R_N$ (input value) of the eccentric lens on the image display portion 21 having its center at the geometrical center $O_G$.

Also, in checking as to whether the external configuration should be machined or not, the equation (6) is rewritten into the following equation (10);

$$(X-\mathrm{IN}+\mathrm{in})^2+(Y-\mathrm{UP}+\mathrm{up})^2=R^2 \quad (10)$$

and all dots of the lens frame configuration coordinates $P_i(X_i, Y_i)$ are substituted into this equation (10), and if there are all coordinate dots as follows;

$$(X_i-\mathrm{IN}+\mathrm{in})^2+(Y_i-\mathrm{UP}+\mathrm{up})^2 \geqq R_N^2 \quad (11)$$

it is judged that the desired lens frame configuration "can be taken" from this eccentric lens.

(5) Calculation/Display of Minimum Lens Diameter Machinable

When the operator judges by his/her eye that the external configuration "cannot be taken" through checking or when it is automatically judged to that effect, if he/she wants to know the minimum lens diameter required to taking the lens frame configuration, he/she operates the minimum lens diameter-key. Then, the arithmetic/judgment circuit 102, as shown in FIG. 3, converts the lens frame coordinates $P_i(X_i, Y_i)$ to coordinates $P_i'$ $(X_i', Y_i')$ of a coordinate system serving the origin $O_L$ as its origin using the following equations;

$$X_i'=X_i-\mathrm{IN} \quad (12)$$

$$Y_i'=Y_i-\mathrm{UP} \quad (13)$$

and then converts the coordinates $P_i'$ $(X_i', Y_i')$ to a coordinate system serving the origin O as its origin using the following equations;

$$\rho_1' = \sqrt{X_1'^2 + Y_1'^2} \quad (14)$$

$$\theta_1' = \tan^{-1}\frac{X_i'}{Y_i'} \quad (15)$$

and then selects the longest one out of the vector radii $\rho_i'$. Then, a lens L' serving this as its radius $R_m$ is the minimum lens required taking the lens frame configuration. Radius $R_m \times 2 = D$ is served as the minimum lens diameter machinable and the same is displaced in numerical value on a minimum diameter-display portion **225*b*. Also, it may be image displayed on the image display portion 21**.

In a machinability judgment apparatus and a lens grinding machine having the same in the above-described embodiments, measuring data of the lens frame 501 coming from the frame configuration measuring apparatus 10 is utilized as the lens frame configuration information. However, the present invention is not limited to this. Information initially stored in a memory medium such as floppy disk and IC card may be utilized as the lens frame configuration information or otherwise, on-line information from a frame maker and agent may be utilized.

As described in the foregoing, according to the present invention, there can be provided a lens machinability judging apparatus, in which the optical center of the uncut lens is decentered from the geometrical center of the lens frame image by a desired amount and therefore, the lens image having a lens diameter of the uncut lens can be image displayed together with the lens frame image. With this apparatus, the operator can check the external configuration machinability in which a judgment is made by the operator's eye as to whether at least a part of the lens frame image is expanded from the lens image. It has such an advantage as that when expanded, it can be checked that the desired lens frame configuration "cannot be taken" even if the material lens should be ground by the lens grinding machine before the material lens is subjected to such machining.

Also, by providing judgment means and warning means, a judgment as to whether at least a part of the lens frame configuration is "expanded" outside the lens image or not can be performed automatically. And when "expanded", the warning means can automatically issue a warning to the operator that the desired lens frame configuration "cannot be obtained" even if the material lens should be ground by the lens grinding machine. By this, the operator is not required to perform a judging operation as to "expansion".

Furthermore, according to the present invention, a construction of a lens machinability judging apparatus and a function thereof can be added to the lens grinding machine. Owing to the foregoing, the invention has such an advantage as that there can be checked as for machinability of the external configuration before the lens is subjected to the machining treatment.

Also, according to the present invention, there can be provided a machinability judging apparatus, in which the lens frame image and the sucking disk external configuration image can be image displayed together by decentering them by decentering amount portion of the lens frame and the uncut lens and the machining interference can be checked by checking whether at least a part of the sucking disk external image is expanded outside the lens frame image or not, before the lens is subjected to the grinding treatment.

Also, there can be provided a machinability judging apparatus, in which an uncut lens with a sucking disk already sucked and attached thereto can be placed on the display screen as such that the sucking disk will be coincident to the sucking disk external configuration image, and by checking whether at least a part of the external periphery of the uncut lens placed on the display screen is expanded from the lens frame image or not, there can be perform an external configuration machinability checking for checking whether a desired lens frame configuration can be taken from this uncut lens before the lens is subjected to the grinding treatment.

Furthermore, there can be provided a lens grinding machine having the machinability judging apparatus, by which there can be checked as to the machining interference and as to the external configuration machinability during the machining process before the material lens is subjected to the grinding treatment.

What is claimed is:

1. An apparatus for judging whether or not an uncut lens should be machined, comprising:

means for receiving vector radius information describing a configuration of a lens frame, said vector radius information indicating a geometrical center of said lens frame;

means for receiving an optical center position of said uncut lens relative to said geometrical center of said lens frame;

means for inputting at least one of a radius and diameter of said uncut lens; and means for simultaneously displaying an image of said lens frame, in accordance with said vector radius information, and an image of said uncut lens such that an image of said geometrical center of said lens frame coincides with an image of said optical center of said uncut lens in accordance with said at least one of said radius or diameter of said uncut lens.

2. The apparatus according to claim 1, further comprising:

means for receiving a frame PD value or distance value between frame geometrical centers of said lens frame;

means for receiving a spectacle user's interpupil distance value;

means for calculating a difference between said frame interpupil distance value and said spectacle user's interpupil distance value to determine an inwardly sided amount of said uncut lens; and means for receiving an upwardly sided amount of said material lens.

3. The apparatus according to claim 1, further comprising:

means for judging whether or not at least a portion of said lens frame image extends outside said uncut lens image; and means for issuing a warning when said judgment means has judged that at least a portion of said lens frame image extends outside said lens image.

4. The apparatus according to claim 2, further comprising:

means for judging whether or not at least a portion of said lens frame image extends outside said uncut lens image; and means for issuing a warning when said judgment means has judged that at least a portion of said lens frame image extends outside said lens image.

5. An apparatus for judging whether or not an uncut lens, having a sucking disc attached thereto, should be machined, said apparatus comprising:

display means for simultaneously displaying an image of a lens frame of a spectacle lens frame and an image of an uncut lens to be enframed therein;

position input means for inputting an optical center position of said uncut lens relative to a geometrical center of said lens frame; and memory means for initially storing an outer configuration of a sucking disk which is sucked and attached to said uncut lens;

said display means displaying said outer configuration of said sucking disk such that a center of said outer configuration of said sucking disk is located at said optical center position of said uncut lens.

6. The apparatus according to claim 5, wherein said display means includes a display surface, said uncut lens with said sucking disk sucked and attached thereto being placed on said display surface such that said sucking disk is coincident with said outer configuration of said sucking disk.

7. The apparatus according to claim 5, wherein said input means includes:

FPD input means for inputting a frame PD value of said spectacle frame;

PD input means for inputting an interpupil distance value of a spectacle user;

arithmetic means for calculating a difference between said frame PD value and said interpupil distance value and for finding an inward adjustment distance of said uncut lens; and UP input means for inputting an upward adjustment distance of said uncut lens.

8. The apparatus according to claim 6, wherein said input means includes:

FPD input means for inputting a frame PD value of said spectacle frame;

PD input means for inputting an interpupil distance value of a spectacle user;

arithmetic means for calculating a difference between said frame PD value and said interpupil distance value and for finding an inward adjustment distance of said uncut lens; and UP input means for inputting an upward adjustment distance of said uncut lens.

9. The apparatus according to claim 5, further comprising:

judgment means for judging whether or not at least a portion of said external configuration of said sucking disk is located outside said configuration of said lens frame; and warning means for issuing a warning when said judgment means has judged that at least a portion of said external configuration of said sucking disk is located outside said configuration of said lens frame.

10. The apparatus according to claim 6, further comprising:

judgment means for judging whether or not at least a portion of said external configuration of said sucking disk is located outside said configuration of said lens frame; and warning means for issuing a warning when said judgment means has judged that at least a portion of said external configuration of said sucking disk is located outside said configuration of said lens frame.

11. The apparatus according to claim 7, further comprising:

judgment means for judging whether or not at least a portion of said external configuration of said sucking disk is located outside said configuration of said lens frame; and warning means for issuing a warning when said judgment means has judged that at least a portion of said external configuration of said sucking disk is located outside said configuration of said lens frame.

12. The apparatus according to claim 8, further comprising:

judgment means for judging whether or not at least a portion of said external configuration of said sucking disk is located outside said configuration of said lens frame; and warning means for issuing a warning when said judgment means has judged that at least a portion of said external configuration of said sucking disk is located outside said configuration of said lens frame.

13. The apparatus according to claim 5, wherein said memory means is adapted to store a radius of a sucking rubber of said sucking disk at a time when said material lens is sucked and attached to said material lens, said radius indicating said external configuration of said sucking disk.

14. The apparatus according to claim 6, wherein said memory means is adapted to store a radius of a sucking rubber of said sucking disk at a time when said material lens is sucked and attached to said material lens, said radius indicating said external configuration of said sucking disk.

15. The apparatus according to claim 7, wherein said memory means is adapted to store a radius of a sucking rubber of said sucking disk at a time when said material lens is sucked and attached to said material lens, said radius indicating said external configuration of said sucking disk.

16. The apparatus according to claim 8, wherein said memory means is adapted to store a radius of a sucking rubber of said sucking disk at a time when said material lens is sucked and attached to said material lens, said radius indicating said external configuration of said sucking disk.

17. The apparatus according to claim 9, wherein said memory means is adapted to store a radius of a sucking rubber of said sucking disk at a time when said material lens is sucked and attached to said material lens, said radius indicating said external configuration of said sucking disk.

18. The apparatus according to claim 10, wherein said memory means is adapted to store a radius of a sucking rubber of said sucking disk at a time when said material lens is sucked and attached to said material lens, said radius indicating said external configuration of said sucking disk.

19. The apparatus according to claim 11, wherein said memory means is adapted to store a radius of a sucking rubber of said sucking disk at a time when said material lens is sucked and attached to said material lens, said radius indicating said external configuration of said sucking disk.

20. An apparatus for machining an uncut lens, comprising:

means for inputting configuration data of a lens frame of a spectacle to be enframed therein;

means for judging whether or not said uncut lens should be machined, said judging means including means for receiving vector radius information describing a configuration of a lens frame, said vector radius information indicating a geometrical center of said lens frame, means for receiving an optical center position of said uncut lens relative to said geometrical center of said lens frame, lens diameter or radius input means for inputting the diameter or radius of said uncut lens, and means for simultaneously displaying an image of said lens frame, in accordance with said vector radius information, and an image of said uncut lens such that an image of said geometrical center of said lens frame coincides with an image of said optical center of said uncut lens; and means for grinding said uncut lens based on said configuration data and on information provided by said judging means.

21. The apparatus according to claim 20, wherein said judging means further includes:

means for receiving a frame interpupil distance value;

means for receiving a spectacle user's interpupil distance value;

means for calculating a difference between said frame interpupil distance value and said spectacle user's interpupil distance value to determine an inwardly sided amount of said uncut lens; and means for receiving an upwardly sided amount of said material lens.

* * * * *